US007707982B2

(12) United States Patent
Fellmann

(10) Patent No.: US 7,707,982 B2
(45) Date of Patent: May 4, 2010

(54) VALVE ROTATING MECHANISM FOR EXHAUST VALVES, ESPECIALLY OF MARINE DIESEL ENGINES

(75) Inventor: Holger Fellmann, Bergisch Gladbach (DE)

(73) Assignee: Märkisches Werk GmbH, Halver (DE)

( * ) Notice: Subject to any disclaimer, the term of this patent is extended or adjusted under 35 U.S.C. 154(b) by 271 days.

(21) Appl. No.: 11/587,508

(22) PCT Filed: Apr. 27, 2004

(86) PCT No.: PCT/EP2004/004437

§ 371 (c)(1),
(2), (4) Date: Nov. 29, 2007

(87) PCT Pub. No.: WO2005/116408

PCT Pub. Date: Dec. 8, 2005

(65) Prior Publication Data

US 2008/0190387 A1 Aug. 14, 2008

(51) Int. Cl.
*F01L 1/32* (2006.01)

(52) U.S. Cl. ..... 123/90.28; 123/90.31; 464/160

(58) Field of Classification Search ..... 123/90.23, 123/90.28, 90.3, 90.16, 90.27, 90.31, 90.15, 123/90.17, 90.18; 464/1, 2, 160; 475/7, 475/228

See application file for complete search history.

(56) References Cited

U.S. PATENT DOCUMENTS 3,938,484 A 2/1976 Mueller

FOREIGN PATENT DOCUMENTS

| | | | |
|---|---|---|---|
| DE | 2739403 | A1 | 3/1979 |
| DE | 3113944 | C2 | 10/1982 |
| DE | 3225725 | A | 1/1984 |
| DE | 19500321 | A | 6/1995 |
| DE | 29522196 | UI | 9/2000 |
| DE | 10315493 | A1 | 10/2004 |
| DE | 102004020754 | B4 | 12/2005 |
| GB | 16598 | A | 11/1916 |

*Primary Examiner*—Ching Chang
(74) *Attorney, Agent, or Firm*—Katten Muchin Rosenman LLP

(57) ABSTRACT

A valve rotating mechanism for exhaust valves, especially of marine diesel engines, which mechanism is braced in a valve housing for the valve stem (1) between an upper and a lower drive element, is linked to the lower drive element via a freewheel device, which transmits rotation of the valve stem (1) during closing movement thereof, and is also braced relative to the upper drive element via a rotary cylinder (15), which brings about rotation of the valve stem (1) through engagement with a fixed support cylinder (13). Therein the rotary cylinder (15) and support cylinder (13) are engaged with one another via a helical gearing, wherein the rotary cylinder (15) is linked to the valve stem (1) via the freewheel device and the support cylinder (13) is fastened on the housing side.

12 Claims, 6 Drawing Sheets

VALVE ROTATING MECHANISM FOR EXHAUST VALVES, ESPECIALLY OF MARINE DIESEL ENGINES

CROSS-REFERENCE TO RELATED APPLICATIONS

This application claims priority to International Application PCT/EP/2004/004437, which was filed Apr. 27, 2004.

BACKGROUND OF THE INVENTION

1. Field of the Invention

The invention relates to a valve rotating mechanism for exhaust valves, especially of marine diesel engines or the like, which mechanism is braced in a valve housing for the valve stem between an upper and a lower drive element, wherein it is linked to the lower drive element via a freewheel device, which allows rotation of the valve stem during closing movement thereof, and wherein it is braced relative to the upper drive element via a rotary cylinder, which brings about rotation of the valve stem through engagement with a fixed support cylinder.

2. Description of the Related Art

Such a valve rotating mechanism is described in German Patent 3113944. The known mechanism comprises two cylindrical portions, which are disposed concentrically relative to one another and between which two balls are guided in rotational movement in such a way that they respectively engage in a ball socket of the one cylindrical portion and in a ball track of the other cylindrical portion, the said track running at an inclination to the cylinder axis. A more uniform distribution of force between the two cylindrical portions is achieved by providing a plurality of ball sockets and ball tracks disposed at intervals around the circumference of the two cylindrical portions. Preferably the ball tracks have the form of a spiral with constant pitch.

In this known valve rotating device, a cylindrical portion is rotated by the fact that the ball guided in the ball socket travels in the ball track of the other cylindrical portion, one of the cylindrical portions being locked by the freewheel device. During closing of the valve stem, the cylindrical portion locked during opening is driven in the direction of rotation.

By means of the known mechanism, a relatively high speed of rotation of the valve stem can be attained during the closing operation; however, some wear of the ball tracks has to be expected, meaning that regular replacement of the corresponding cylindrical portions is inevitable.

SUMMARY OF THE INVENTION

In contrast, the object of the present invention is to provide a valve rotating mechanism of the type mentioned hereinabove that is particularly durable and can be subjected to high loads, while nevertheless responding with high acceleration.

This object is achieved according to the invention by the fact that the rotary cylinder and support cylinder are engaged with one another via a helical gearing, wherein the rotary cylinder is linked to the valve stem via the freewheel device, and the support cylinder is fastened to the valve housing.

The inventive valve rotating mechanism is suitable in principle for all slowly running marine engines, but in particular for two-cycle engines, in which the upper drive element is formed by a hydraulic cylinder for controlling the opening stroke of the valve and the lower drive element is formed by the piston of a pneumatic cylinder for controlling the closing movement of the valve.

In modern marine engines, the spring plates of earlier design, between which the valve rotating mechanism was braced, have been replaced by a hydraulic cylinder, which forms the upper end of the valve housing, and whose oil piston moves the valve stem in the direction in which it opens, so that it lifts from the valve seat, as well as by a pneumatic cylinder acting in the opposite direction, to move the valve stem by means of its pneumatic piston back in closing direction after compression. An air pressure of approximately 7 bar is sufficient for this purpose, whereas the oil pressure acting on the oil piston is as high as 170 bar.

In a further configuration of the invention, the support cylinder is provided with an internal helical gearing, which in axial direction corresponds at least to the length of the opening stroke of the valve plus the minimum engagement length of the two cylinders.

Correspondingly, the rotary cylinder is provided with an external gearing, which in axial direction corresponds at least to the minimum engagement length of the two cylinders.

Examples of suitable toothing data for the helical gearing are a tooth height of approximately 3 to 5 mm and a pitch of smaller than 45°.

By the fact that the support cylinder preferably has a gearing extending continuously over its entire length, whereas the rotary cylinder has an external gearing that extends downward only over approximately one third of its length from its upper end in installed position, lower manufacturing costs are achieved for the rotary cylinder; moreover, the remaining annular gap between the two cylinders can be exploited more effectively for oil lubrication.

Expediently, the support cylinder is fastened by shrink-fitting of its outer circumference in a corresponding seat of the hydraulic cylinder. In the region of its fastening, an annular lubricating groove can be advantageously provided on the outside of the support cylinder, thus supplying the gearing with lubricating oil via radial bores.

In contrast, the rotary cylinder is mounted with its inner circumference via an axial bearing inside a cylindrical hollow of the piston of the pneumatic cylinder, the shank of the valve stem being received by friction fit in a central through bore of a hub of the piston.

The rotary cylinder is therefore axially immovable with the piston, but is nevertheless mounted to rotate relative thereto in a direction of rotation permitted by the freewheel device.

For this purpose it is expedient for the shank of the valve stem to be wedged frictionally in the through bore by means of a clamping part and for the clamping part to be formed as a cone bushing, which is axially secured by a compression ring bolted to the hub of the piston. Suitable as the clamping part are conical ring segments, preferably of steel according to SAE 1010, that engage via an inner bead in a corresponding annular groove of the shank of the valve stem in the manner described in U.S. Pat. No. 3,938,484. The pressure exerted on the clamping part by means of the compression ring is such that the shank of the valve stem is released at a certain torque, in the manner of a slipping clutch; in other words, it can slip before other components of the valve rotating mechanism would be destroyed, such as those at the same end as the freewheel device.

Finally, it is provided according to the invention that there is fastened onto the hub of the piston of the pneumatic cylinder a ratchet wheel of the freewheel device, in whose circumferential toothing there engages a plurality of ratchet elements mounted at intervals around the circumference in depressions of the rotary cylinder, where they are respectively braced by spring loading. Expediently, an annular projection of the ratchet ring simultaneously functions as the axial bracing of the axial bearing, which preferably comprises a double-track ball bearing. By the fact that the ratchet wheel is disposed between compression ring and hub, the possibility exists of fastening the compression ring by passing bolts through bores of the ratchet wheel into the hub of the piston.

It is self-evident that the hydraulic cylinder and pneumatic cylinder are separated from one another by the piston of the pneumatic cylinder. Below its piston, the pneumatic cylinder contains the compressed-air cushion responsible for restoring the valve to closing direction; above the piston there is provided a space for collection of the hydraulic oil being discharged, which oil is simultaneously effective as lubricating oil. For this purpose, it is intended according to the invention that the rotary cylinder will be provided above the freewheel device with a plurality of radial bores disposed at intervals around its circumference and that annular gaps for the hydraulic oil being discharged through these will be provided between the two cylinders as well as between the support cylinder and the hollow of the piston. From there the hydraulic oil being discharged then travels via an annular gap bounded by the outer circumference of the pneumatic cylinder through further radial bores in the valve housing to the outside and back into the oilpan or an oil reservoir.

The inventive valve rotating mechanism is disposed between an upper and a lower drive element, wherein both drive elements, namely the hydraulic cylinder and the pneumatic cylinder act via their respective pistons on the shank of the valve stem. The axial movement thereof produces the rotation of the rotary cylinder, corresponding to the helical gearings of both cylinders. The opening stroke of the valve stem produces a rotary movement of the rotary cylinder in a direction of rotation permitted by the freewheel device in response to linear movement of the stem. The closing movement of the valve stem while the hydraulic cylinder is unpressurized causes rotation of the rotary cylinder in the opposite direction of rotation under the action of the compressed-air cushion, meaning that the ratchet elements of the freewheel device drive the ratchet wheel, via which the rotary movement is transmitted to the valve stem. This rotary movement of the valve stem is exploited to grind in the valve disk onto the valve seat on the housing side at the instant that the seat faces on both sides meet one another. The grinding movement ends with increasing pressure when the seat is reached, a short over-travel phase corresponding to the inertial torque of the valve stem being possible because the freewheel device permits slipping of the ratchet wheel.

The inventive valve rotating mechanism is suitable not only for installation in new engines; it is also suitable for retrofitting into the respective valve housing, by machining the hydraulic cylinder, especially by equipping it with the support cylinder, and by providing the pneumatic cylinder with a new piston, on which the other parts of the valve rotating device are mounted.

With the inventive valve rotating mechanism, it is now possible to prolong the useful life of the valve stem between two overhauls considerably, for example from 6,000 hours heretofore to approximately 18,000 hours for two-cycle engines. This is achieved by the high rotational energy attainable by means of the inventive valve rotating mechanism during grinding in of the valve disk onto the valve seat on the housing side, a well defined rotational energy acting at the instant that the seat position is reached. Thereby there is achieved desired polishing effect, by which deposits in the region of the valve seat faces are eliminated, in conjunction with the advantage that thereby heat transfer between the metallically bright valve seat faces is improved, advantageously resulting in a lower temperature in the region of the valve cone seat.

BRIEF DESCRIPTION OF THE DRAWING

A practical example of the invention will be described hereinafter on the basis of the drawing, wherein.

DETAILED DESCRIPTION OF THE INVENTION

Figure 1:
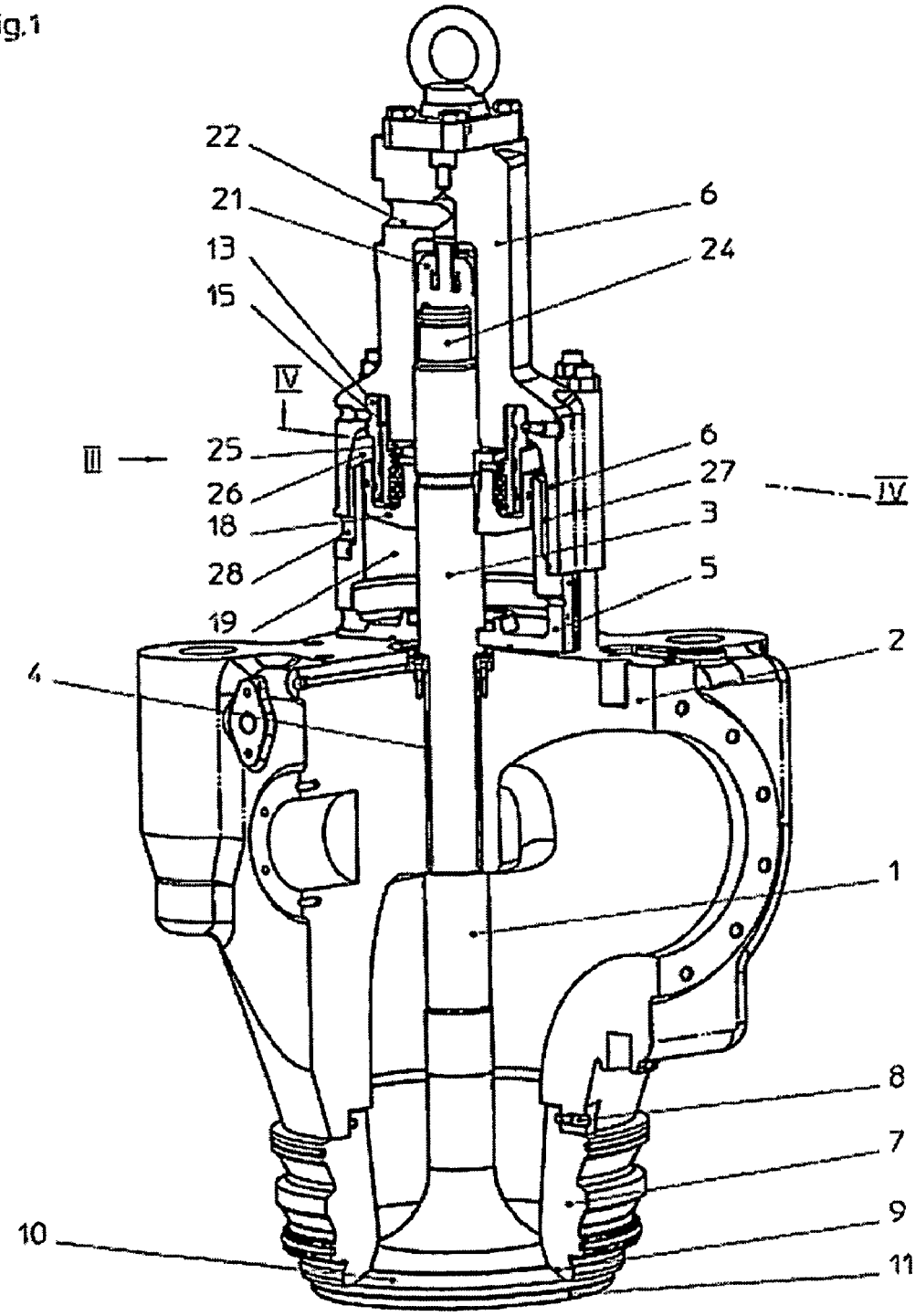
FIG. 1 shows a cutaway three-dimensional diagram of a valve housing.
Figure 2:
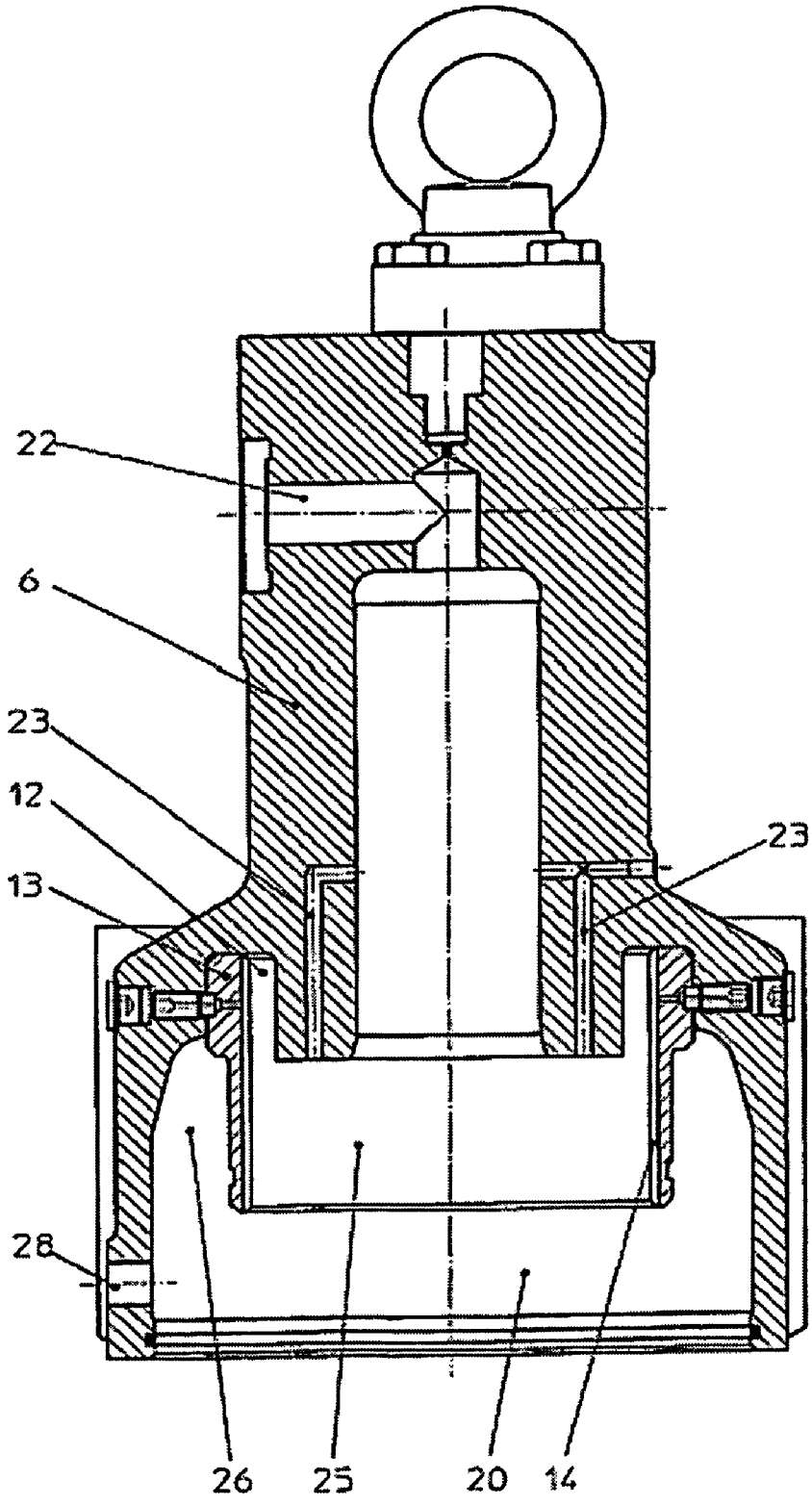
FIG. 2 shows the upper part of the valve housing with cutaway hydraulic cylinder.

FIG. 1 shows the valve housing of a two-cycle diesel engine for a marine propulsion unit with valve stem 1 installed therein in its closed position. On a valve housing 2, in which shank 3 of valve stem 1 is mounted to rotate inside a bearing bushing 4, there is seated a pneumatic cylinder 5 and thereon a hydraulic cylinder 6. The latter is separately illustrated in the same cutaway diagram in FIG. 2. On the underside of valve housing 2 there is inserted thereinto, on the housing side, a valve seat ring 7, which is fixed there by means of bolts 8. With its open end, valve seat ring 7 forms the valve seat face on the housing side, which face comprises a material portion 9 formed by pretreatment such as hardening or weld-surfacing with hard alloy, and which cooperates with a corresponding valve seat face 10 (valve cone seat) on the upper side of valve disk 11.

Figure 5:
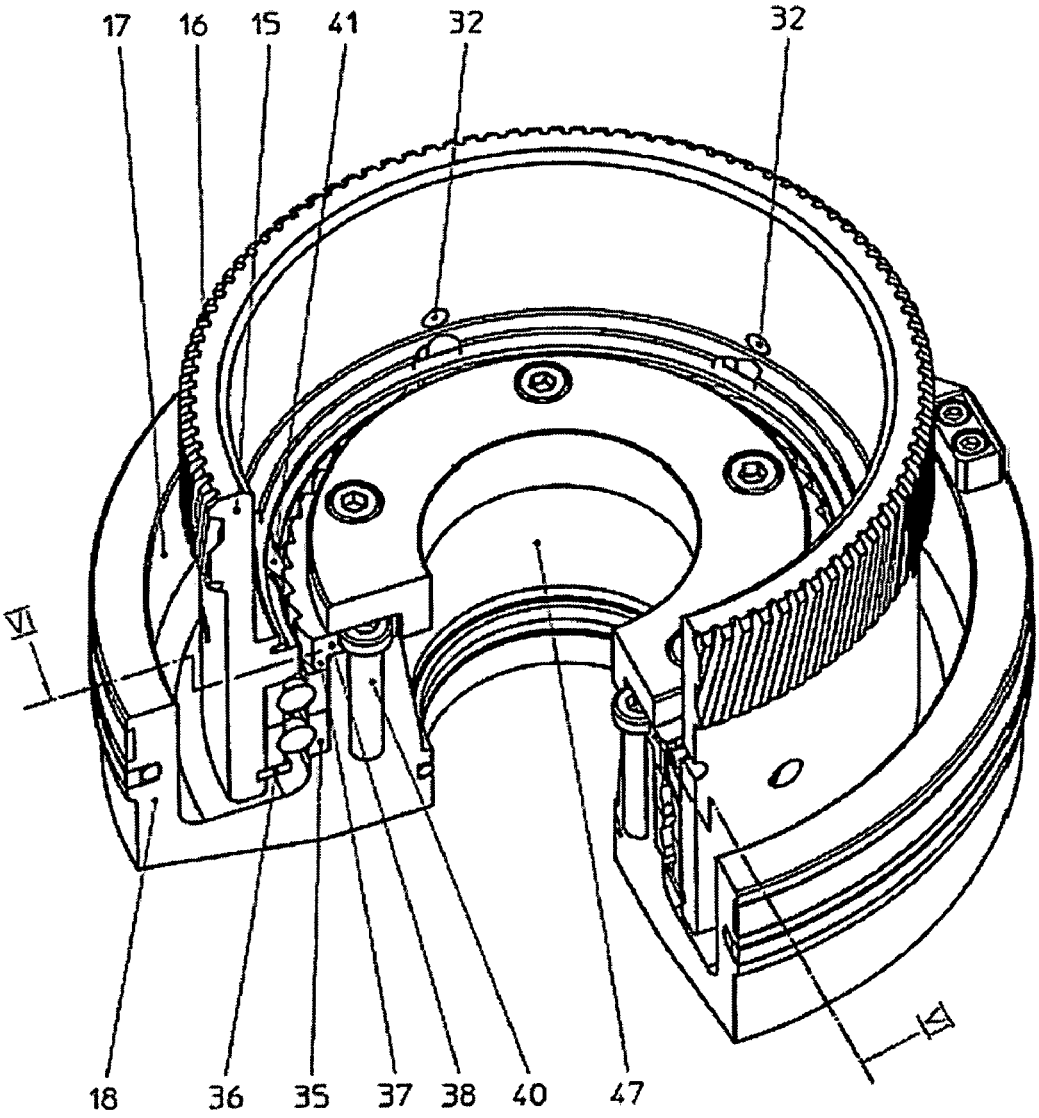
FIG. 5 shows a cutaway three-dimensional diagram of the piston of the pneumatic cylinder and FIG. 6 shows a section according to VI-VI of FIG. 5.

In a turned recess 12 of hydraulic cylinder 6 there is fastened a support cylinder 13 by shrink-fitting onto its outer circumferential face. On its inner circumferential face, support cylinder 13 has a helical gearing 14, with which there is engaged a rotary cylinder 15, which is provided on its outer circumferential face with an external gearing 16 corresponding to internal gearing 14 of support cylinder 13. Rotary cylinder 15, which is illustrated on a larger scale in FIG. 5, is received rotatably in a hollow 17 of pneumatic piston 18, which is received sealingly and in axially displaceable relationship inside pneumatic cylinder 5. Pneumatic piston 18 separates the compressed air side containing cylindrical space 19 for the compressed-air cushion from a discharge chamber 20 for the hydraulic oil, which functions simultaneously as lubricating oil.

In the upper part of the cylindrical space of hydraulic cylinder 6 there is shown at the top dead center a hydraulic piston 21, to which hydraulic oil is admitted via an oil-hydraulic line 22. As is evident in FIG. 2, the stroke of hydraulic piston 21 in the direction of the opening movement of valve stem 1 is limited by discharge ducts 23, which open into discharge chamber 20 for the hydraulic oil.

Hydraulic piston 21 embraces upper end 24 of valve stem 3 in the form of a bell, in order to move this downward in the opening direction of the valve stem at oil pressures of up to 170 bar. Acting in the opposite direction thereto is pneumatic piston 18, which is also joined firmly and sealingly to the valve stem, as will still be described hereinafter in connection with FIGS. 3 and 5. Cylindrical space 19 of pneumatic cylinder 5 is in communication with the compressed-air supply of the operating system, which makes 5 to 7 bar available for closing the valve stem. The compressed-air cushion in cylindrical space 19 moves valve stem 1 back in closing direction as soon as this has reached the bottom dead center (not illustrated) at maximum open position and the oil pressure in hydraulic cylinder 6 has been correspondingly reduced. During its discharge, the hydraulic oil is forced to flow out of discharge lines 23 via an internal region 25 of discharge chamber 20 and through diverse bores and annular spaces, as will be described in more detail hereinafter in conjunction with FIG. 3, into an outer region 26 of discharge chamber 20 of hydraulic cylinder 6, and from there via an annular space 27 between hydraulic cylinder 6 and pneumatic cylinder 5 and further through radial bores 28 in hydraulic cylinder 6 back to the oil reservoir.

Figure 3:
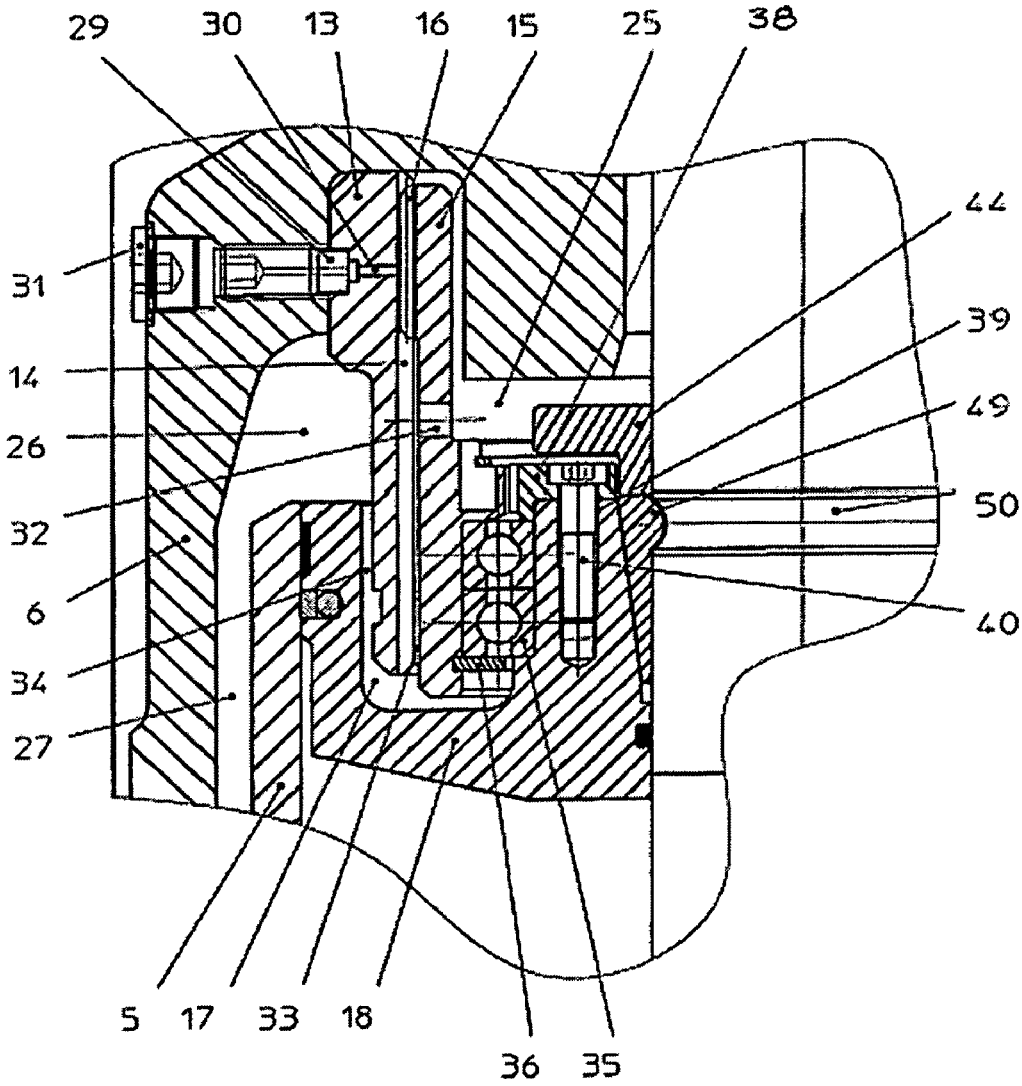
FIG. 3 shows detail III according to FIG. 1 in an enlarged diagram.

FIG. 3 shows detail III of FIG. 1 in an enlarged diagram. It includes hydraulic cylinder 6 with support cylinder 13 fastened therein, external gearing 16 of rotary cylinder 15 being engaged with the internal gearing 14 of the said support cylinder. External gearing 16 has much shorter extent in axial direction than the internal gearing of support cylinder 13. In this way, the two cylinders remain constantly engaged with one another during the opening stroke of valve stem 1. Helical gearings 14, 16 are adequately lubricated by the hydraulic oil being discharged; for additional lubrication of the threaded linkage there can also be provided a circumferential lubricating groove 29, which is in communication with internal gearing 14 of support cylinder 13 via radial bores 30 therethrough. Lubricating groove 29 is supplied with lubricating oil via an oil port 31. A minimum engagement length is sufficient for the threaded linkage, and so external gearing 16 of rotary cylinder 15 has only approximately one half to one third of the axial length of internal gearing 14 of support cylinder 13. Besides the cost savings associated therewith, there is achieved a larger cross section for the hydraulic oil being discharged in annular gap 33 between the two cylinders; this oil flows via radial bores 32 of rotary cylinder 15 out of the internal region 25 of discharge chamber 20, after which it flows via annular gap 33 between the two cylinders downward via hollow 17 of pneumatic piston 18 and then back upward through an annular space 34 between the outer wall of extension 17 and the outer circumference of support cylinder 13 into outer space 26 of discharge chamber 20 of hydraulic cylinder 6. From this outer region 26, the hydraulic oil then flows outward via an annular space 27 between the outer circumference of pneumatic cylinder 5 and the inner circumference of hydraulic cylinder 6 through outlet bores 28 in the cylindrical wall of hydraulic cylinder 6.

Bracing of rotary cylinder 15 inside hollow 17 of pneumatic piston 18 is assumed by an axial bearing, which is composed of an axial ball bearing 35. Further axial bracing thereof is provided by a lower support ring 36, which fits into a corresponding groove on the inside of rotary cylinder 15, as well as by a collar 37 of a ratchet wheel 38 of a freewheel device. Ratchet wheel 38 is fastened by means of bolts 40 onto a hub 39 of pneumatic cylinder 18.

Figure 4:
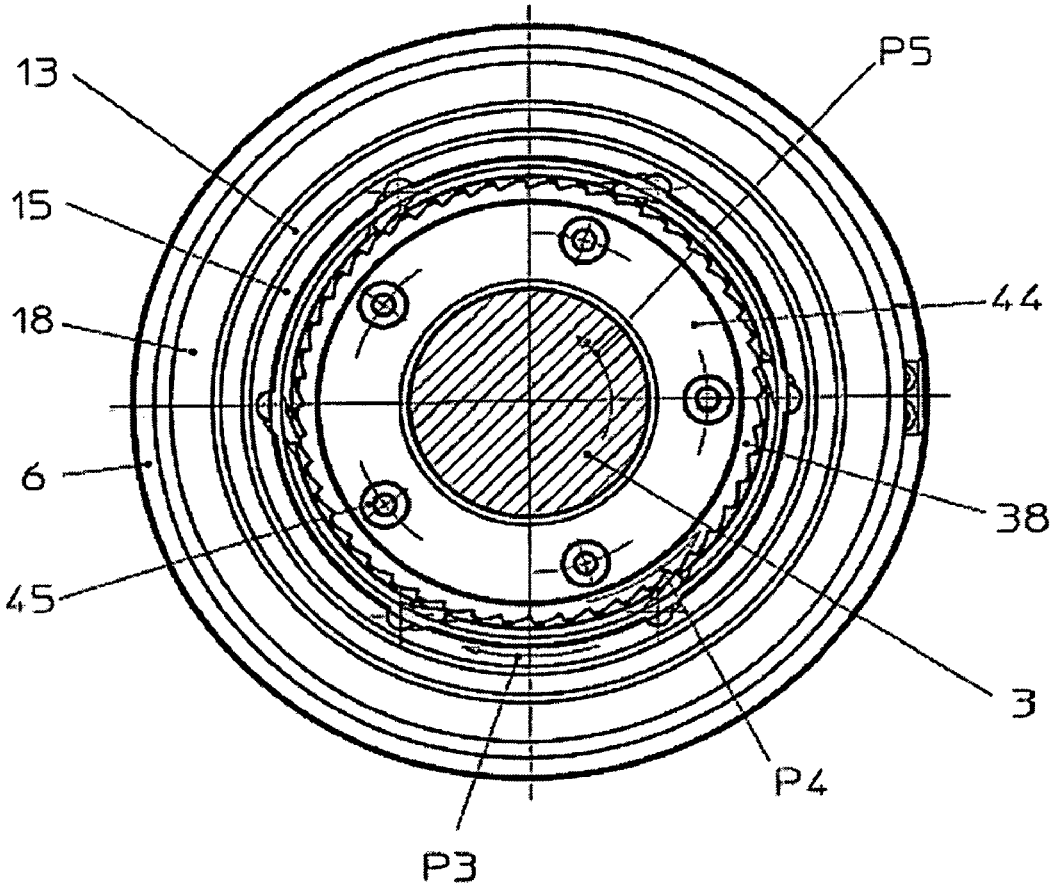
FIG. 4 shows a section according to IV-IV of FIG. 1, also in an enlarged diagram.

FIG. 4 shows ratchet wheel 38, which is covered on top by a compression ring 44, which is also bolted by means of bolts 45 onto hub 39 of pneumatic cylinder 18. Accordingly, ratchet wheel 38 has bores 46, through which bolts 45 are screwed in. These bores 46 for passing bolts 45 through and into ratchet wheel 38 are illustrated in the diagram according to FIG. 6. Bolts 40, also present therein, function to fasten ratchet wheel 38.

Figure 6:
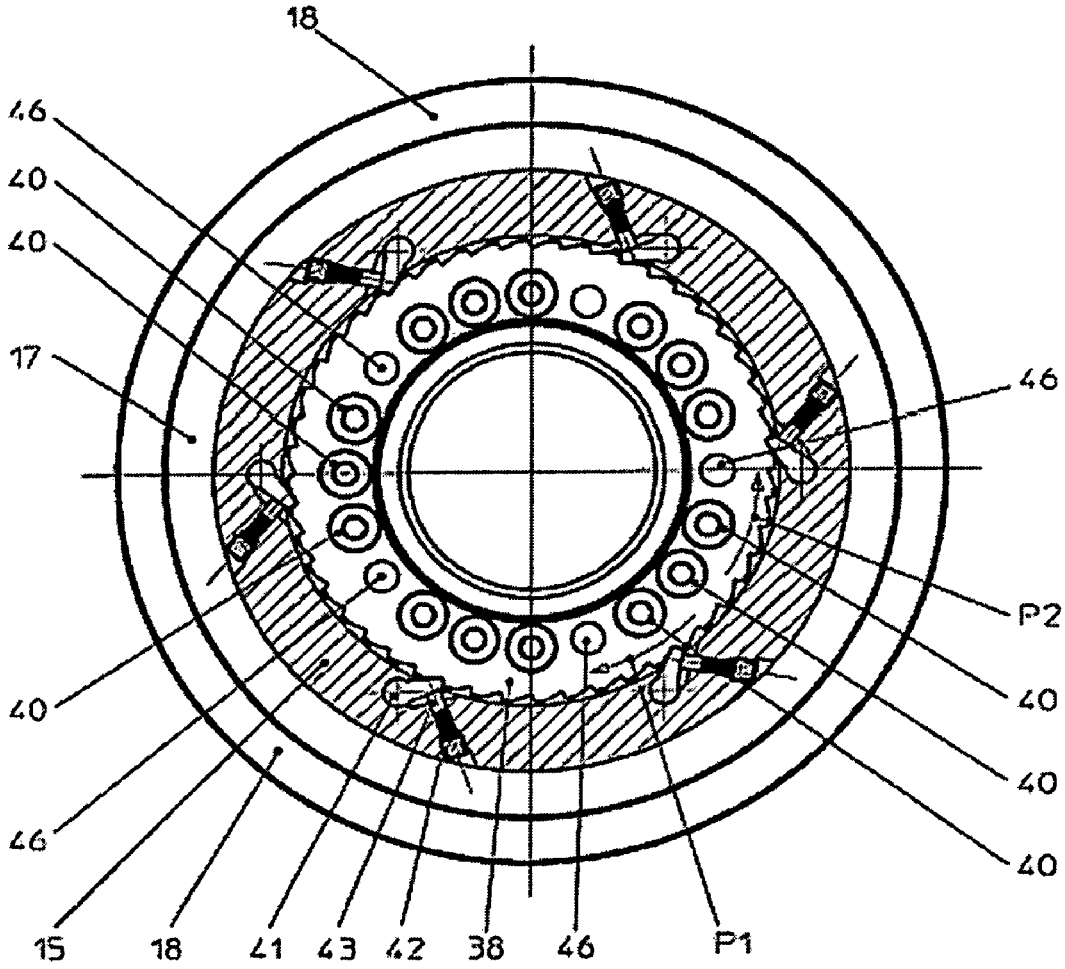

FIG. 6, which represents a section according to VI-VI of FIG. 5, shows a horizontal section through rotary cylinder 15, in which six ratchet elements 41 are mounted at intervals around the circumference. Each of these ratchet elements 41 is held in locking position with its detent pawl by a plunger 43 urged by a ratchet spring 42. This locking position prevents rotation of ratchet wheel 38 relative to rotary cylinder 15 in a direction of rotation according to arrow P1. On the other hand, rotation of ratchet wheel 38 relative to rotary cylinder 15 against the spring action of plunger 43 is possible in the opposite direction of rotation according to arrow P2. In such a case, the pawls of ratchet elements 41 slide out of the way over the teeth of ratchet wheel 38.

The enlarged sectional diagram according to FIG. 5 is used to illustrate the arrangement of rotary cylinder 15 inside hollow 17 of pneumatic piston 18. Support cylinder 13 has been omitted from this diagram. Illustrated particularly clearly is the central bore in pneumatic cylinder 18, which ends conically upward.

Between this conical expansion 47 of the receiving bore for shank 3 of valve stem 1 and the outer circumference of shank 3 there is wedged in a clamping part that is clearly visible in FIG. 3 and that has the form of a cone bushing 48, which is axially secured by compression ring 44. On its inner side, close to its upper rim, cone bushing 48 has an inwardly protruding bead 49, which engages in a corresponding annular groove 50 of shank 3 of valve stem 1.

When valve stem 1 is moved by feed of hydraulic oil via oil-hydraulic line 22 from the closed position shown in FIG. 1 downward in the direction of valve opening, in which hydraulic piston 21 exerts a corresponding force on upper end 24 of valve shank 3, this axial stroke movement brings about a corresponding axial adjustment of rotary cylinder 15, which rotates in the direction of arrow P3 (FIG. 4) while being braced on support cylinder 13, whereas the valve tappet is moved straight downward, thus opening the valve seat.

Conversely, when the compressed-air cushion in cylindrical space 19 moves pneumatic piston 18 upward after the hydraulic cylinder has become depressurized, thus lifting valve stem 1 in the direction of the closed position, the helical gearing between the two cylinders brings about rotation of rotary cylinder 15 in the direction opposite the direction of rotation according to arrow P3. This has the result that the freewheel device locks, or in other words ratchet elements 41 being moved together with rotary cylinder 15 drive ratchet wheel 38, making it rotate in the direction of arrow P4 (FIG. 4), valve stem 1 then being rotated correspondingly therewith via cone bushing 48. This rotation of valve stem 1 causes valve disk 11 to grind in against the valve seat on the housing side at the instant that it reaches the valve seat, thus making the seat faces grind one another in the desired manner. The valve seat faces occupying the two sides and forming the valve seat are polished smooth in this process, thus achieving a leaktight valve seat and also improving the heat exchange between valve disk 11 and the valve seat ring on the housing side. The direction of rotation of the valve disk during the grinding-in action is indicated by arrow P5 in FIG. 4, and it corresponds to the direction of rotation of the ratchet wheel according to arrow P4. By virtue of the mass inertia of the valve stem, the possibility exists that the valve stem will continue to rotate according to arrow P5 while the freewheel device is still ratcheting according to arrow P2, even though rotary cylinder 15 is already stationary.

The invention claimed is:

1. A valve rotating mechanism for an exhaust valve, the mechanism comprising:

a first helical gear disposed on a rotary cylinder, the rotary cylinder being linked to a valve stem via a freewheel device, the freewheel device transmitting rotation of the valve stem during a closing movement of the valve stem;

a second helical gear disposed on a support cylinder, the support cylinder being fixed to a housing of the exhaust valve;

wherein the first and second helical gears engage to rotate the valve stem relative to the support cylinder;

wherein the first helical gear comprises a first gear length along a longitudinal axis of the valve stem, the first gear length comprising the minimum engagement length of the rotary and support cylinders; and wherein the second helical gear comprises a second gear length along the longitudinal axis of the valve stem, the second gear length comprising a stroke length of the valve stem during an opening movement and the minimum engagement length of the rotary and support cylinders.

2. The valve rotating mechanism of claim 1, wherein the rotating valve mechanism is incorporated in a marine diesel engine.

3. The valve rotating mechanism of claim 1, wherein the support cylinder comprises a shrink-fit seat.

4. The valve rotating mechanism of claim 1, wherein the first gear is an external helical gear and the second gear is an internal helical gear.

5. The valve rotating mechanism of claim 1, wherein the valve stem is braced against an upper drive element by the rotary cylinder and is braced against a lower drive element by the support cylinder, the upper drive element being a hydraulic cylinder for controlling the opening movement and the lower drive element being a pneumatic cylinder for controlling the closing movement.

6. The valve rotating mechanism of claim 5, further comprising a hub in the pneumatic cylinder for receiving a shank of the valve stem in a friction fit.

7. The valve rotating mechanism of claim 6, further comprising compression ring and a cone bushing for friction fitting the shank in the hub.

8. The valve rotating mechanism of claim 5, wherein the freewheel device comprises a ratchet wheel fastened to the hub, a ratchet of the ratchet wheel engaging depressions provided in the rotary cylinder.

9. The valve rotating mechanism of claim 1, wherein the rotary cylinders comprises a plurality of bores disposed at intervals around a circumference of the rotary cylinder.

10. The valve rotating mechanism of claim 1, further comprising annular gaps for discharging hydraulic oil between the rotary and support cylinders.

11. The valve rotating mechanism of claim 1, further comprising an annular lubricating groove for lubricating the second helical gear.

12. The valve rotating mechanism of claim 1, further comprising an an axial bearing provided in the pneumatic cylinder, the axial bearing for supporting the rotary cylinder at an inner circumference of the rotary cylinder.

* * * * *